US005522462A

United States Patent [19]

Kumar et al.

[11] Patent Number: 5,522,462

[45] Date of Patent: Jun. 4, 1996

[54] PLATE HEAT EXCHANGER

[75] Inventors: Hemant Kumar; Graham A. Lamont, both of Goldsboro, N.C.

[73] Assignee: APV Corporation Limited, England

[21] Appl. No.: 211,018

[22] PCT Filed: Sep. 15, 1992

[86] PCT No.: PCT/GB92/01693

§ 371 Date: Apr. 21, 1994

§ 102(e) Date: Apr. 21, 1994

[87] PCT Pub. No.: WO93/06426

PCT Pub. Date: Apr. 1, 1993

[30] Foreign Application Priority Data

Sep. 16, 1991 [GB] United Kingdom ..... 9119727

[51] Int. Cl.[6] ..... F28F 3/08

[52] U.S. Cl. ..... 165/166; 165/167

[58] Field of Search ..... 165/166, 167

[56] References Cited

U.S. PATENT DOCUMENTS 4,911,235 3/1990 Andersson et al. ..... 165/166
4,915,165 4/1990 Dahlgren et al. ..... 165/166
4,966,227 10/1990 Andersson ..... 165/166
5,291,945 3/1994 Blomgren et al. ..... 165/166

FOREIGN PATENT DOCUMENTS 1552439 11/1968 France .
2064750 6/1981 United Kingdom .
2128726 5/1984 United Kingdom .
WO87/01795 3/1987 WIPO .

*Primary Examiner*—John C. Fox
*Attorney, Agent, or Firm*—Quarles & Brady

[57] ABSTRACT

In a plate heat exchanger having a welded plate pair comprising first and second plates (2, 4) which are welded together at a contact region (19), a by-pass area (22) is defined between the plates on the inboard side of the contact region (19). The plates (2,4) are so shaped and arranged that a second by-pass area (22*a*) similar to the first, is defined between the second plate (4) and the first plate (2*a*) of an adjacent, similar, plate pair, on the inboard side of a gasket (28) clamped between the two plate pairs. A gasket groove (18) in the first plate has an inner side wall which is substantially continuous and which is of fixed or variable height substantially greater than zero.

30 Claims, 2 Drawing Sheets

PLATE HEAT EXCHANGER

The present invention relates to a plate type heat exchanger, and more particularly to an improved seal between adjacent plates in a plate type heat exchanger. Each such pair of plates will be referred to herein as a "plate pair".

Plate type heat exchangers consist of a number of heat transfer plates which are clamped together in a stack in face to face relationship to define flow channels between the adjacent :plates. Two streams of media each flow through respective sets of alternate channels, the media being in heat exchange contact through the intervening plates. The plates are sealed together at their edges and in the region of two pairs of entry and exit ports provided at the corners of the plates. A pair of ports connects with one set of alternate flow spaces and is sealed from the other set.

Considerable attention has been paid to the seal between adjacent plates. Most typically in the past the outer edges of adjacent plates, and the region around the ports, have been sealed together by gaskets which sit in a groove formed in one of the plates, the groove supporting the gasket against being forced outwards by pressurised medium in the flow space. More recently, the gaskets have been replaced in whole or in part by a permanent joint, such as adhesive, solder, braze, a plastic mould or by welding. This may be done to provide a cheaper seal or to provide increased security against leakage of the medium from between the plates.

In one prior art form of welded seal, a metal gasket is welded into a groove in a plate and is welded to the base of a corresponding groove in the adjacent plate, that corresponding groove carrying an elastomeric gasket which seals between adjacent plate pairs. Such metal gaskets are expensive.

In another prior art form of welded seal, a pair of adjacent plates is arranged with its gasket carrying grooves back to back, the mating bases of the grooves being welded together. A thick elastomeric gasket forms the seal between the pairs of welded plates, the gasket fitting in the facing grooves. This mirror image arrangement results in the formation of a double gap by-pass channel which runs alongside the welded joint and provides a significantly large region of faster flow of the media between the plates compared to the flow in the flow space proper, adversely affecting the performance of the heat exchanger.

According to our invention in a plate pair for a plate type heat exchanger, in which the plate pair comprises first and second plates permanently joined together at an edge region to form a seal, the first plate is provided in the edge region with a groove facing away from the second plate for receiving a gasket to form a seal with a second similar, adjacent, plate pair, and the underside of the groove mates with and contacts a sealing portion of the second plate in a contact region at which the two plates are permanently joined together to form the plate pair with a first by-pass area defined between the plates inboard of the contact region, the groove and the sealing portion are so shaped and arranged that a second by-pass area is defined between the second plate and the first plate of an adjacent, similar, plate pair, and the groove has an inner side-wall which is substantially continuous and which is of fixed or variable height.

By altering the profiles of the first and second plates slightly we are able therefore to provide first by-pass area which is similar to conventional gasketted systems. Since the second by-pass area may be similar to the first by-pass area we are able to achieve similar flow rates between the plates of a plate pair and between adjacent plate pairs. This maintains the performance of a heat exchanger.

A base of the groove may mate with a planar region at the edge of the second plate of the pair, the planar region extending beyond the inner side wall of the groove in the first plate.

The plates are permanently sealed together by welding, brazing, soldering, plastic, or elastomeric seals.

Preferably, the base of the groove in the first plate is positioned below an upper boundary the plane of the second plate.

In another construction, the groove of the first plate may nest in a groove in the second plate. In such a construction the depth of the groove in the first plate may be twice the depth of the groove in the second plate.

By nesting the sealing region of the plates in this manner, the by-pass area adjacent the seal can particularly be made comparable to the by-pass area in more conventional gasketed systems.

The invention will be further described by way of example with reference to the accompanying drawings, in which.

Figure 1:
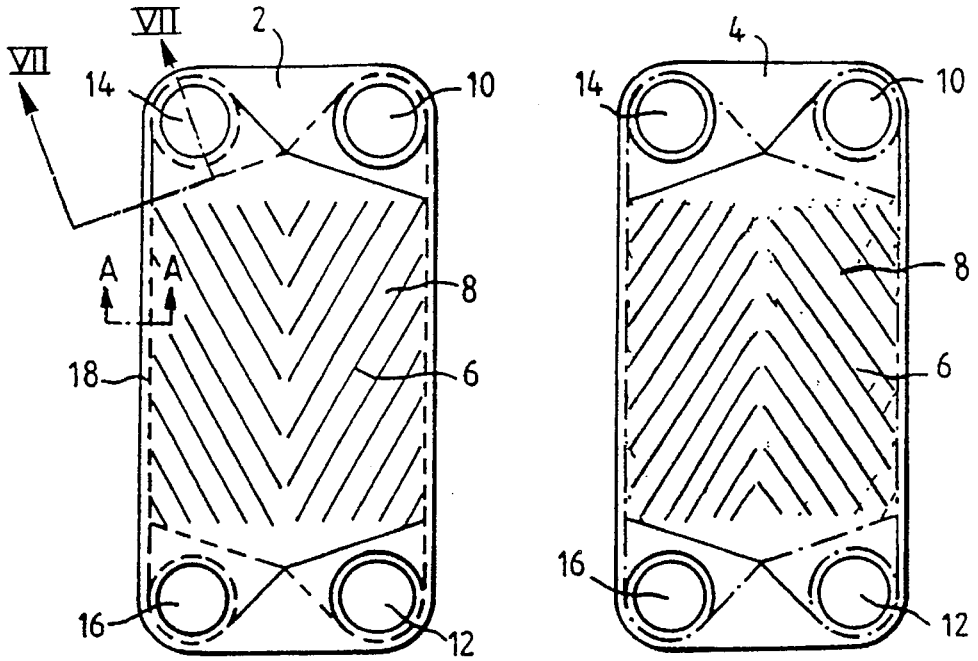
FIG. 1 is a schematic plan view of two heat exchanger plates.

FIG. 1 shows a pair of plates 2, 4 of a plate heat exchanger. The plate 2 is laid over the plate 4 and a seal is formed between the plates to define a flow space between the plates. Plate pairs, comprising pairs of adjacent plates, are then stacked and releasably sealed together with elastomeric gaskets, alternate flow spaces being defined between the adjacent pairs.

Each plate 2, 4 has a pattern of corrugations 6 covering a heat transfer surface 8. The corrugations of the adjacent plates bear on one another at respective upper and lower boundary planes (B—B) to hold the plates apart when they are compressed in a stack and to define a tortuous flow path. Inlet and outlet holes 10, 12 provide for fluid to flow through the flow space between the plates 2, 4 of a pair. Through flow holes 14, 16 are sealed from the flow space, and connected with the flow space formed between adjacent pairs of plates.

In the drawing of the first plate 2, the dash line indicates the line of the permanent seal between the pair of plates, whilst the chain-dot line of the second plate 4 shows the line of the releasable gasket seal provided between adjacent pairs of plates, the gasket being fitted to the front face of plate 2 or the rear face of plate 4.

Figure 2:
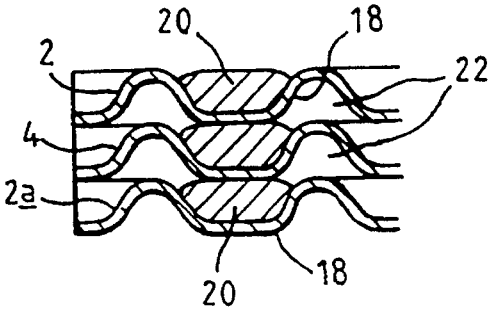
FIG.2 (PRIOR ART)
FIGS. 2, 3 and 4 are cross-sectional views of the edge region of a stack of heat exchanger plates, showing prior art systems for sealing between the plates, taken generally along the line A—A of FIG. 1.

FIG. 2 shows a cross-section, along line A—A of FIG. 1, through a pair of plates 2, 4 and the upper plate 2*a* of an adjacent pair in a conventional style gasket sealing arrangement. The plates each have a groove 18 running peripherally and an elastomeric gasket 20 sits in each groove 18 and forms a seal between adjacent plates. Adjacent the groove 18, on the side of the flow space formed between the adjacent plates, is a by-pass area 22 which presents a relatively low resistance flow path for the medium which flows between the plates. It is desirable to minimise this by-pass area to ensure even heating or cooling of the medium.

Figure 3:
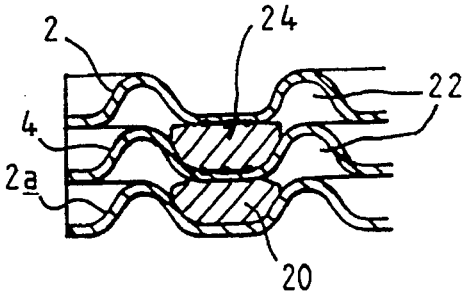
FIG.3 (PRIOR ART)

FIG. 3 shows a prior art system for forming a permanent seal between the pair of plates 2, 4 to form a plate pair, in which a metal gasket 24 is welded in position to seal between the plates 2, 4. The metal gasket is used to provide, for example, enhanced resistance to corrosive fluids and to allow for high pressure between the plates of the welded pair 2, 4. The solid metal gaskets 24 are expensive.

Figure 4:
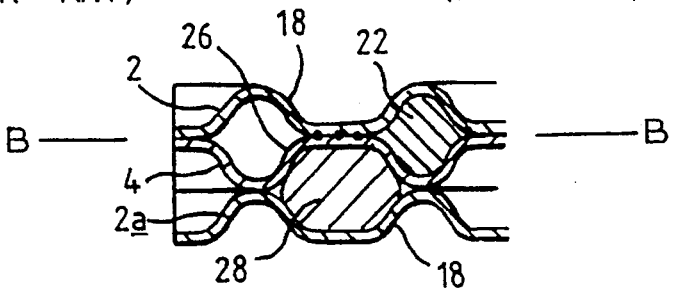
FIG.4 (PRIOR ART)

FIG. 4 shows a gasket system as described in GB-A-2 064 750 in which the gasket groove 26 of the lower plate 4 of a plate pair is reversed, so that the grooves 18, 26 are back to back, and a welded seam (shown by the large dots) is formed along the bottom of the grooves 18, 26 to form a plate pair. A double height gasket 28 seals between the plates (4, 2*a*) of adjacent plate pairs. It can be seen that a double height by-pass area 22 (shown by hatched lines) is formed between the plates 2, 4 of a welded plate pair, no continuous by-pass area being formed between the mating plates 4, 2*a* of adjacent pairs.

Figure 5:
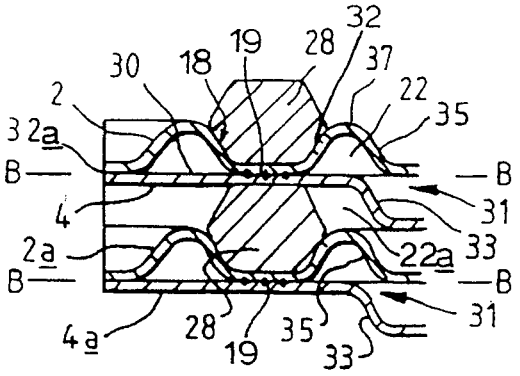
FIG. 5 is a view similar to FIGS. 2 to 4 but illustrating a first embodiment of the invention.

In FIG. 5, there is shown a first embodiment of the invention comprising a pair of upper and lower plates 2 and 4 which are sealed together to form a plate pair. In the embodiment, the configuration of the upper plate 2 is conventional and similar to that in FIG. 4 with a gasket groove 18. The inner side wall 32 of the groove 18 is formed by an inverted groove 37 which faces the lower plate 4 and forms a flow by-pass area 22. The groove 18 has an inner side-wall which is substantially continuous and which is of fixed or variable height substantially greater than zero. The lower plate 4 is largely of conventional configuration but is not provided with a gasket groove, and a flat area 30 is formed at the edge of the plate. The flat area 30 is formed at the upper boundary plane (B—B) (as viewed in the drawing) of the plate 4 and extends laterally of the inner side wall 32 of the groove 18 on the side of the flow space 31 to merge with the corrugated heat transfer surface 8 of the plate, at a wall 33 which extends towards the adjacent plate 2*a* generally parallel to the inner wall 35 of the inverted groove 37.

The base of the gasket groove 18 is secured to the lower plate 4 at a contact region 19 to form a permanent seal. This is achieved by a welding, brazing, or soldering operation.

It can be seen that by extending the plate 4 into the boundary plane B—B opposite the groove 37 the by-pass area 22 is comparable to the by-pass area of the conventional gasketted system of FIG. 2, and similar to a second by-pass area 22*a* between the lower plate 4 and the adjacent plate 2*a*. The second by-pass area 22*a* is disposed inboard of and in communication with the gasket 28 itself. In the embodiment of FIG. 5, the flat area 30 extends out to the outer edge 32*a* of the plate 4.

Figure 6:
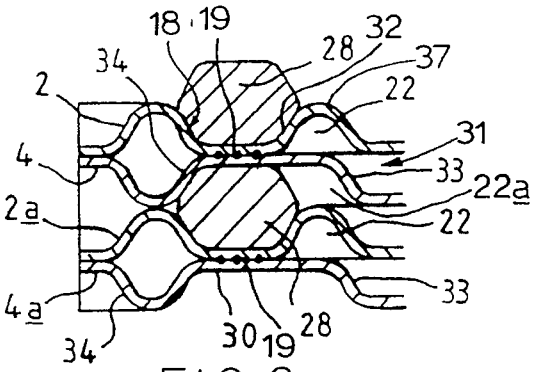
FIG. 6 illustrates a second embodiment of the invention.

The embodiment of FIG. 6 is similar to that of FIG. 5, except a lip 34, which may be continuous or discontinuous is formed in the flat region 30 on the outer edge of the plate 4, to provide greater support for the thick gasket 28.

Figure 7:
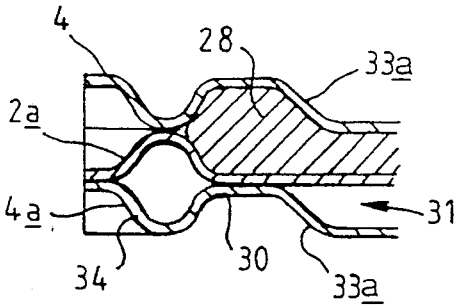
FIG. 7 illustrates an edge region of the plates of FIG. 6, taken generally along the line VII—VII of FIG. 1, near a transfer port.

As shown in FIG. 7, in the entry and exit zones adjacent the ports 10, 12 the sealing surface of plate 4 is tapered at 33*a* to provide a flow gap for fluid to enter the flow space 31, and the gasket 28 between the pairs of plates is correspondingly stepped.

Figure 8:
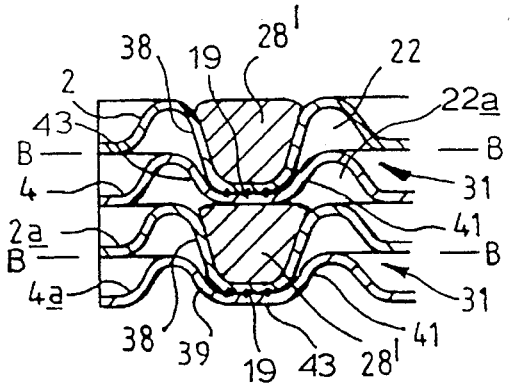
FIG. 8 illustrates a third embodiment of the invention.

In the embodiment of FIG. 8, the upper plate 2 is provided with a deep gasket groove 38 which extends below the upper boundary plane B—B of the lower plate 4 to nest in a groove 43 in the lower plate 4. The deep groove 38 supports a thick gasket 28' between the plates 4, 2*a* of the adjacent plate pairs.

It will be appreciated that the groove 43 in plate 4 may be shallower, so that the groove 38 need only extend a short distance below the mid-plane B—B, the preferred extremes of the range of depth of the gasket groove being illustrated by the embodiments of FIG. 5 and 8. Also, the outer wall 39 of the groove 43 need not be provided. For example, the plate 4 may extend outwards (to the left in the drawing) in the plane of base of groove 43, and it may extend upwards near its outer edge to meet the outer edge of the plate 2.

The inner wall 41 of the groove 43 extends upwards towards the first plate 2 to reduce the by-pass area 22.

The deep groove 38 is preferably stepped up to the level of the mid-plane B—B in the region of the entry and exit ports 10, 12. The cooperating groove and the gasket in this region being stepped also.

Figure 9:
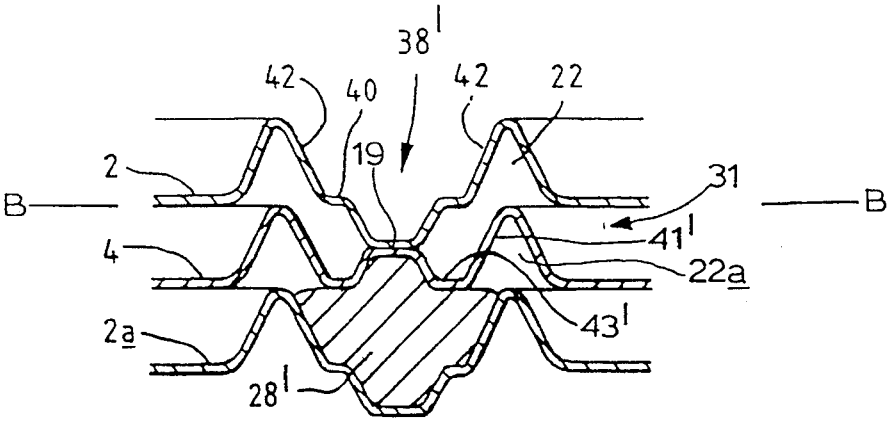
FIG. 9 illustrates a fourth embodiment of .the invention.

In the embodiment of FIG. 9, the base of the groove 43' in the lower plate 4 is stepped upwards so as to lay at about half the plate height and a step 40 is provided in the sidewalls 42 of the deep upper groove 38', which is about 1.1/2 plate heights deep. The contact region 19 comprises the engagement between the lower face of the groove 38' and the upwards step in the lower plate 4. The inner wall 41' of the groove 43' extends upwardly towards the upper plate 2 to reduce the by-pass flow area 22.

In each plate pair described above with reference to FIGS. 5–9, each of the two plates may be constructed from the same material, or from different materials.

Each of the two plates 2, 4, 2*a*, 4*a* of each plate pair may also comprise two or more layers of sheet material which rest into each other. The layers may be constructed from the same material, or from different materials.

We claim:

1. A plate pair for a plate type heat exchanger, said plate pair comprising first and second plates, said first and second plates each having an edge region, said first and second plates being permanently joined together at said edge region to form a seal at a contacting region, in which said first plate defines in said edge region a groove, said groove facing away from said second plate, said groove receiving a gasket to form a further seal with a second similar, adjacent, plate pair, said groove having an underside, said underside of said groove mating with and contacting a sealing portion of said second plate in said contact region, said first and second plates inboard of said contact region defining a first by-pass area, said groove, said sealing portion, said second plate and said first plate of an adjacent, similar, plate pair, being so shaped and arranged as to define a second by-pass area, said groove defining an inner side-wall, said side-wall being substantially continuous and being fixed or variable in height.

2. A plate pair according to claim 1, in which said second plate has a region adjacent said contact region on the side of the said by-pass area, said region extending towards said first plate.

3. A plate pair according to claim 2, in which said base of said groove in said first plate is positioned below an upper boundary plane of said second plate.

4. A plate pair according to claim 1, in which said groove has a base, said edge of said second plate of said pair having a planar region, said base mating with said planar region, said planar region extending beyond the inner side wall of said groove in said first plate.

5. A plate pair according to claim 4, in which said planar region is formed in an upper boundary plane of said second plate.

6. A plate pair according to claim 5, in which said inner edge of said planar region is terminated by a wall, said wall extending away from said first plate towards a first plate of an adjacent plate pair.

7. A plate pair according to claim 6, having entry and exit ports, in which, in the vicinity of said entry and exit ports, said wall is formed closer to said contact region.

8. A plate pair according to claim 1, in which said groove of said first plate nests in a groove in said second plate.

9. A plate pair according to claim 8, in which the depth of said groove in said first plate is twice the depth of said groove in said second plate.

10. A plate pair according to claim 8, in which said groove in said second plate defines an inverted portion, said inverted portion being of a height less than the maximum depth of said groove in said second plate and said groove in said first plate is, for at least part of its width, twice said maximum depth of said groove in said second plate less the height of said inverted portion of said groove of said second plate, said contact region comprising the lowest base of said first plate and the upper surface of said inverted portion of said second plate.

11. A plate pair according to claim 1, in which said inner edge of said planar region is contiguous with a heat exchanging portion of said second plate.

12. A plate pair according to claim 1, in which each plate comprises a plate element, said plate element being constructed from at least two layers of sheet material, said layers nesting into each other.

13. A plate pair according to claim 12, in which said layers are constructed from the same material.

14. A plate pair according to claim 12, in which said two layers are constructed from different materials.

15. A plate pair according to claim 1, in which said two plates are joined together at said contact region by a permanent joint comprising welding, soldering, or brazing.

16. A heat exchanger of the multi-plate type comprising adjacent plate pairs of which the plates of each pair are permanently sealed together, and gaskets disposed between adjacent plates of adjacent plate pairs form seals, each of said plate pair comprising first and second plates, said first and second plates each having an edge region, said first and second plates being permanently joined together at said edge region to form a seal at a contacting region, in which said first plate defines in said edge region a groove, said groove facing away from said second plate, said groove receiving a gasket to form a further seal with a second similar, adjacent, plate pair, said groove having an underside, said underside of said groove mating with and contacting a sealing portion of said second plate in said contact region, said first and second plates inboard of said contact region defining a first by-pass area, said groove, said sealing portion, said second plate and said first plate of an adjacent, similar, plate pair, being so shaped and arranged as to define a second by-pass area, said groove defining an inner side-wall, said side-wall being substantially continuous and being fixed or variable in height.

17. A plate pair according to claim 16, in which said second plate has a region adjacent said contact region on the side of the said by-pass area, said region extending towards said first plate.

18. A plate pair according to claim 17, in which said base of said groove in said first plate is positioned below an upper boundary plane of said second plate.

19. A plate pair according to claim 16, in which said groove has a base, said edge of said second plate of said pair having a planar region, said base mating with said planar region, said planar region extending beyond the inner side wall of said groove in said first plate.

20. A plate pair according to claim 19, in which said planar region is formed in an upper boundary plane of said second plate.

21. A plate pair according to claim 20, in which said inner edge of said planar region is terminated by a wall, said wall extending away from said first plate towards a first plate of an adjacent plate pair.

22. A plate pair according to claim 21, having entry and exit ports, in which, in the vicinity of said entry and exit ports, said wall is formed closer to said contact region.

23. A plate pair according to claim 17, in which said groove of said first plate nests in a groove in said second plate.

24. A plate pair according to claim 23, in which the depth of said groove in said first plate is twice the depth of said groove in said second plate.

25. A plate pair according to claim 23, in which said groove in said second plate defines an inverted portion, said inverted portion being of a height less than the maximum depth of said groove in said second plate and said groove in said first plate is, for at least part of its width, twice said maximum depth of said groove in said second plate less the height of said inverted portion of said groove of said second plate, said contact region comprising the lowest base of said first plate and the upper surface of said inverted portion of said second plate.

26. A plate pair according to claim 16, in which said inner edge of said planar region is contiguous with a heat exchanging portion of said second plate.

27. A plate pair according to claim 16, in which each plate comprises a plate element, said plate element being constructed from at least two layers of sheet material, said layers nesting into each other.

28. A plate pair according to claim 27, in which said layers are constructed from the same material.

29. A plate pair according to claim 27, in which said two layers are constructed from different materials.

30. A plate pair according to claim 16, in which said two plates are joined together at said contact region by a permanent joint comprising welding, soldering, or brazing.

* * * * *